US012383796B2

(12) United States Patent
Repiquet

(10) Patent No.: US 12,383,796 B2
(45) Date of Patent: Aug. 12, 2025

(54) DETACHABLE AQUATIC PROPULSION DEVICE

(71) Applicant: S.C.P. PHORCYS DIVING, Monaco (MC)

(72) Inventor: Yann-Philippe Repiquet, Menton (FR)

(73) Assignee: S.C.P. PHORCYS DIVING, Monaco (MC)

( * ) Notice: Subject to any disclaimer, the term of this patent is extended or adjusted under 35 U.S.C. 154(b) by 0 days.

(21) Appl. No.: 18/865,264

(22) PCT Filed: May 10, 2023

(86) PCT No.: PCT/EP2023/062491
§ 371 (c)(1),
(2) Date: Nov. 12, 2024

(87) PCT Pub. No.: WO2023/217900
PCT Pub. Date: Nov. 16, 2023

(65) Prior Publication Data

US 2025/0161757 A1 May 22, 2025

(30) Foreign Application Priority Data

May 12, 2022 (MC) ..... 2716

(51) Int. Cl.
*A63B 31/12* (2006.01)

(52) U.S. Cl.
CPC ..... *A63B 31/12* (2013.01)

(58) Field of Classification Search
CPC ..... A63B 31/00; A63B 31/08; A63B 31/10; A63B 31/11; A63B 31/12
USPC ..... 441/55, 60, 61, 63, 64
See application file for complete search history.

(56) References Cited

U.S. PATENT DOCUMENTS 3,268,927 A 8/1966 Markowitz
5,645,460 A * 7/1997 Johnson ..... A63B 31/14 441/63
6,126,502 A * 10/2000 Hull ..... A63B 31/11 441/63

(Continued)

FOREIGN PATENT DOCUMENTS

DE 10 2011 112 980 B4 10/2018
FR 3 069 443 A1 2/2019
WO 2016094930 A1 6/2016

OTHER PUBLICATIONS

International Search Report issued in PCT/EP2023/062491; mailed Jul. 31, 2023.

(Continued)

*Primary Examiner* — Daniel V Venne
(74) *Attorney, Agent, or Firm* — Studebaker Brackett PLLC

(57) ABSTRACT

An aquatic propulsion device to be worn on at least one leg of a swimmer includes at least one first portion configured to be securely attached to the leg of the swimmer. The first portion includes a first bearing part having a first inner face shaped so as to bear on the tibia of the swimmer, and a first outer face opposite to the first inner face. The device also includes a second portion having a foil for propelling the swimmer, a second bearing part carrying the foil and having a portion complementary with the first bearing part so that the device has an attached configuration and a detached configuration.

20 Claims, 8 Drawing Sheets

(56) References Cited

U.S. PATENT DOCUMENTS

| | | | | |
|---|---|---|---|---|
| 8,678,870 | B2 * | 3/2014 | Johnson | A63B 31/12 441/60 |
| 9,457,231 | B2 * | 10/2016 | Rodgers, Jr. | A63B 31/11 |
| 2003/0036322 | A1 | 2/2003 | Wilson | |
| 2005/0079777 | A1 | 4/2005 | Couzyn | |
| 2010/0075554 | A1 | 3/2010 | Johnson | |
| 2011/0104968 | A1 | 5/2011 | Johnson | |
| 2017/0007888 | A1 | 1/2017 | Stroud | |

OTHER PUBLICATIONS

Written Opinion issued in PCT/EP2023/062491; mailed Jul. 31, 2023.

* cited by examiner

DETACHABLE AQUATIC PROPULSION DEVICE

TECHNICAL FIELD OF THE INVENTION

The present invention relates to the field of finning devices. It finds a particularly advantageous application in the field of scuba diving.

PRIOR ART

In the aquatic field, there are several devices allowing assisting a swimmer in his/her movements. In particular, swimfins which allow facilitating swimming of divers by enlarging the surface pushing on the water. Nevertheless, conventional fin devices have limitations because they particularly load the ankles of the swimmers, and this result in fatigue injuries or sprains and strains.

Solutions allowing overcoming this problem exist such as that one described in document FR3069443A1 in which there is described in particular a fin foil connected at the level of the tibia of a diver, so that the pushing force is generated by the diver directly by the muscles of the legs and the tensions are no longer concentrated at the level of the ankles.

In practice, it arises that this solution allows only a limited propulsion. Moreover, this solution proves to be inconvenient to use because, for example, the fin foil cannot be easily attached/detached under water.

Hence, it is an object of the present invention is to provide a reliable solution allowing overcoming this problem associated with the excessive loading of the ankles, allowing for an improved propulsion and being easy to handle under water.

The other objects, features and advantages of the present invention will become apparent upon examining the following description and the appended drawings. It should be understood that other advantages could be incorporated.

SUMMARY OF THE INVENTION

To achieve this objective, according to one embodiment, an aquatic propulsion device is provided configured to be worn at least at one leg of a swimmer and comprising:

- at least one first portion configured to be securely attached to the leg of a user, the first portion comprising:
- a first bearing part having a first inner face shaped so as to bear on the tibia of the swimmer and a first outer face opposite to the first inner face.

The device also comprises a second portion comprising:

- a foil for propelling the swimmer,
- a second bearing part carrying the foil and having a portion complementary with the first bearing part so that the device has:
- an attached configuration in which the second bearing part cooperates with the first bearing part to removably secure, preferably by suppressing all degrees of freedom, the second bearing part on the first outer face of the first bearing part in order to transmit a finning force from the first portion to the foil of the second portion,
- a detached configuration in which the cooperation of the second bearing part with the first bearing part is suppressed so that the second portion is completely disengaged from the first portion.

Thus, this enables a walking or running configuration of the swimmer in which the foil is detached and can be transported by hand. This also enables the user to put on or remove the second portion underwater and potentially giving it to another diver, underwater or outside the water.

Indeed, the device is configured to allows securing the first portion with the second portion easily. Coupling of the first portion and of the second portion being performed via the first bearing part and the second bearing part, in contact with each other, they enable the transmission of forces from the tibia of the user up to the foil.

Without the present invention, a facilitated alternation between a walking configuration and a swimming configuration would not be possible for a user who should necessarily put off the entire device.

The solutions of the prior art are unsatisfactory for several reasons and in particular because the foils are complex to put off, and all the more underwater and consequently they are in practice fitted on a watercraft or on the shore.

Thus, the present solution proposes not only a walking configuration with the foil being detached but also allows easy handling of the foil in and outside the water.

Hence, with the present solution, it is now possible to overcome the problem related to the excessive loading of the ankles while enabling the use of a removable foil.

BRIEF DESCRIPTION OF THE FIGURES

The aims, objects, as well as the features and advantages of the invention will appear better from the detailed description of an embodiment of the latter which is illustrated by the following appended drawings, wherein.

Figure 1:
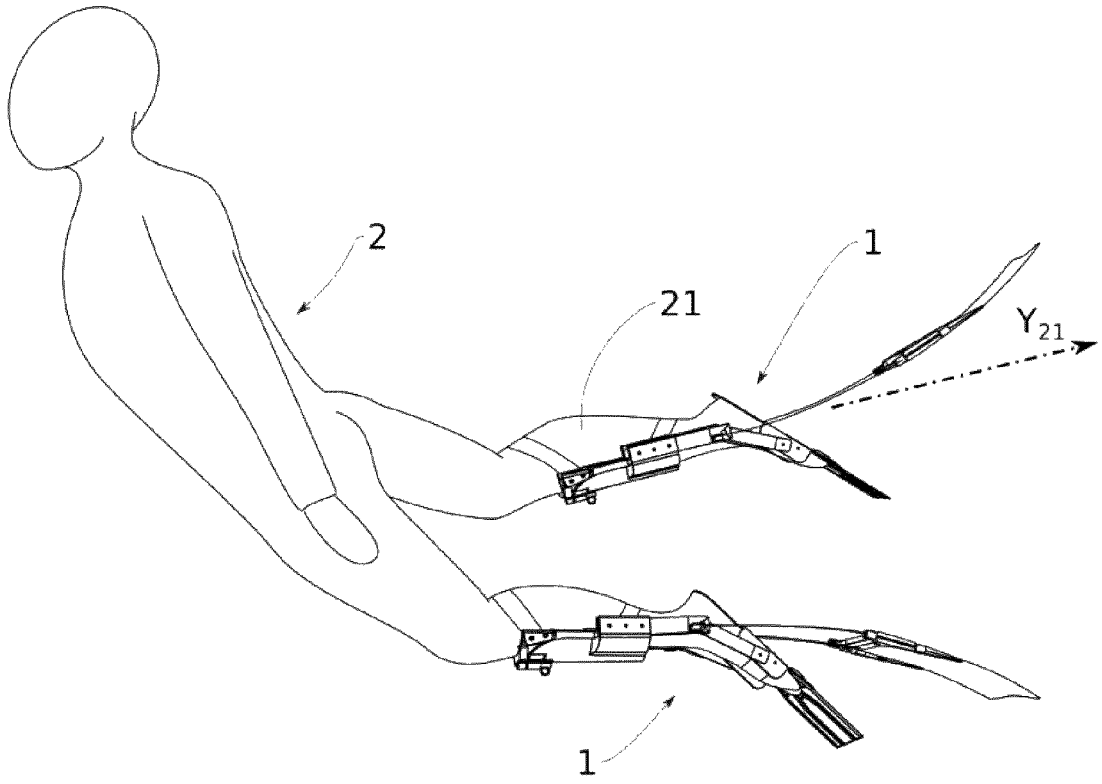
FIG. 1 shows a swimmer equipped at each leg with an example of a propulsion device according to the present invention in a swimming configuration.

The drawings are given as examples and do not limit the invention. They form block diagrams intended to facilitate understanding of the invention and are not necessarily plotted to the scale of practical applications.

DETAILED DESCRIPTION

Before starting a detailed review of embodiments of the invention, optional features are set out hereinafter, which could possibly be used in combination or alternatively:

According to one example, the device configured so that, in the attached configuration, the second portion is secured to the first portion only by said cooperation between the second bearing part and the first bearing part.

According to one example, the first portion comprises a first attachment member and the second portion comprises a second attachment member complementary with the first attachment member, the actuation of one amongst the first and the second attachment member allowing alternately switching between:

- a locked configuration in which the first and second attachment members cooperate so as to lock the device in the attached configuration, and an unlocked configuration in which the first and second attachment members enable switching of the device from the attached configuration into the detached configuration.

Thus, according to this example, the two members are configured so as to cooperate with one another to:

lock the second bearing part on the first bearing part in the attached configuration, unlock the second bearing part on the first bearing part in the detached configuration.

According to one example, the first and second attachment members cooperate by clipping and/or via a latch mechanism.

Preferably, this is not a screw-nut connection.

According to one example, the device is configured so that the actuation of one amongst the first and second attachment members is performed by handling of this member by the swimmer to switch from the attached configuration into the detached configuration.

According to one example, the actuation of one amongst the first and second attachment members is caused, preferably only, by cooperation of the second portion on the first portion to switch from the detached configuration into the attached configuration.

Thus, the swimmer does not have to handle said attachment member to attach the second portion on the first portion. Hence, he/she can quickly switch into the swimming configuration, even in a delicate condition, for example when he/she is in the water.

According to one example, the first portion comprises a first pivot member, secured to the first bearing part and the second portion comprises a second pivot member, the two pivot members being configured to cooperate, preferably by interlocking, so as to switch from the detached configuration into the attached configuration by tilting of the second bearing part relative to the first bearing part.

Thus, the first pivot member and the second pivot member guide the relative movement of the second bearing part relative to the first bearing part during the alternating switch from the detached configuration into the attached configuration. Handling by the user is facilitated, which is particularly desirable in a constraining situation, for example when the swimmer is in the water, underwater and/or when he/she must act quickly.

According to one example, the first pivot member and the second pivot member are configured to guide the relative movement of the second bearing part relative to the first bearing part during the alternating switch from the detached configuration into the attached configuration, according to a rotation about a first axis substantially perpendicular to a main direction of extension of the tibia.

According to one example, the device is configured so that the amplitude of the rotation by tilting of the second portion relative to the first portion is limited by the contact between the second inner face and the first outer face.

Preferably, the main direction extends parallel to the direction defined by the malleoli of the user.

Thus, the first portion and the second portion can be easily assembled together.

Therefore, this solution enables an improved propulsion of the swimmer. As well as an easy assembly/disassembly of the foil underwater.

The solution allows leaving the ankles of the swimmer free while enabling an improved propulsion. Preferably, the ankles of the swimmer are thus guided in rotation according to the main direction and laterally stopped by the foil supports.

According to one example, the two members are configured so as to cooperate at the end of the tilting movement, when there is a contact between a second inner face of the second portion with the first outer face of the first portion.

According to one example, the actuation of one amongst the two attachment members is performed manually without any tool. Preferably, the actuation of one amongst the two members is performed with one hand. The actuation of one amongst the two members could be performed by pulling a latch, a tab or a loop.

According to one example, in the attached configuration, the foil is positioned at a distance of at least 10 cm from the first bearing part so as to form, in the second portion, an opening enabling passage of the foot of the user through said space.

According to one example, in the attached configuration, the foil extends substantially, in continuation of the direction of the tibia of the user.

Advantageously, in the attached configuration, the device is configured so that the foot of the user is located between the first portion and the second portion.

According to one example, the second portion comprises at least one foil support connecting the second bearing part to the foil, the foil support being able to deform elastically during use thereof, under the effect of a finning force applied by the user.

Advantageously, the foil support being shaped so as not to deform under the effect of its own weight.

The foil support being shaped so that, when it is immersed, it deforms under the effect of a finning force applied by the user and then when this finning force is suppressed, and then returns to its rest position.

Thus, the foil support restores part of the force that has caused deformation thereof to the device. This allows improving the performance of the device.

According to one example, the device comprises a third portion comprising an intermediate member and a piece of equipment configured so as to accommodate the foot of the user at least partially, the intermediate member being rotatably articulated with the first portion according to a first axis, and the equipment being rotatably articulated with the intermediate member according to an intermediate axis parallel to and not coincident with the first axis.

Preferably, the second intermediate axis is parallel to the first axis. Thus, when the device is worn by a user, the first axis extends substantially according to the direction defined by the malleoli of the tibia and of the fibula of said swimmer. Preferably, in projection according to an antero-posterior axis of the user.

Preferably, the rotation of the third portion with the first portion could be performed about an additional axis distinct from the first axis, but preferably substantially parallel to the first axis. The additional axis could be substantially parallel to the first axis and distant therefrom. Preferably, the additional axis and the first axis will be coincident so as to extend in the axis of the malleoli of the swimmer in a configuration in the device is worn.

According to one example, the second portion is configured so as to form between the second bearing surface and the foil a space enabling, in the attached configuration, the free movement of the third portion throughout said space and relative to the second portion.

According to one example, the equipment is an accessory, such as a slipper, comprising a closed profile configured to surround the foot of the user, preferably at least at the level of the plantar arch.

According to one example, the device comprises an additional foil secured to the equipment and configured to be positioned under the foot of the user, the additional foil having a widthwise dimension, according to the first axis, substantially with the same size as the width of the equipment.

This allows enlarging the plantar surface of the swimmer and thus further increasing the propulsion force when the water is pushed back with the foot sole.

Preferably, the additional foil has a lengthwise dimension, perpendicular to the widthwise dimension, smaller than 30 cm. The reduced dimension of the second foil facilitating walking of the swimmer. The reduced dimensions of the second foil also enables passage of the third portion through said opening when the device is in the attached configuration.

Preferably, the second foil is glued under the equipment.

According to one example, the foil is made of a first material having a Young's modulus E1 and the foil support is made of a second material having a Young's modulus E2, the first material and the second material being such that E1<E2.

Preferably, the first material has a lower stiffness than the second material.

According to one example, the second portion comprises at least two foil supports, preferably distributed symmetrically on each side of the foil and configured so as to support said foil.

Preferably, each foil support has:

- a proximal end defining with the first portion a pivot connection to form said rotatable articulation of the second portion relative to the first portion according to a first axis, and
- a distal end.

Said opening extends from the proximal ends in the direction of the distal ends. Preferably, the foil is supported by a distal portion of the second portion, the distal portion extending from the distal ends.

The foil support may be in the form of a flat bar or profile.

According to one example, the first bearing part is curved and is configured to come into contact with the front of the leg of the swimmer and the first portion comprises an attachment system, preferably adjustable, configured to enable holding of the first bearing part in position against the front of the leg of the swimmer. Preferably, against the tibia of the swimmer.

According to a particular embodiment, the bearing part is carried by a rigid portion of the first portion. Advantageously, the bearing part has a concave surface.

According to one example, the first bearing part and the second bearing part comprise complementary surfaces with curved shapes.

According to one example, at least one amongst the foil support and the foil is made of a composite material.

Preferably, the main direction of extension of the device extends, in the attached configuration, in continuation of the tibia of the swimmer.

According to one example, the second bearing part has a curved surface so as to interlock together with the first bearing part.

According to one example, the device comprises two first distinct portions respectively configured to be fastened to each of the legs of the user.

According to one example, the two first portions respectively comprise an attachment member each configured to cooperate with a complementary attachment member carried by a unique second portion configured to cooperate simultaneously with the two first portions, the second portion thereby allowing securing the two first portions in the attached configuration.

Thus, the device forms a single-fin.

By "finning movement", it should be understood the movement necessary for the actuation of the device, it could be understood as a succession of oscillations of the legs of the swimmer.

In the present patent application, the term movable corresponds to a rotational movement or to a translational movement or to a combination of movements, for example the combination of a rotation and a translation.

In the present patent application, when it is indicated that two parts are distinct, this means that these parts are separate. They are:

- positioned at distances from each other, and/or
- movable relative to one another, and/or
- secured to each other while being fastened by affixed elements, this fastening could be demountable or not.

Hence, a one-piece part cannot consist of two distinct parts.

In the present patent application, the term "secured" used to describe the connection between two parts means that the two parts are connected/fastened with respect to each other, according to all degrees of freedom, except if is explicitly specified otherwise. For example, if it is indicated that two parts are secured in translation according to a direction X, this means that the parts could be movable relative to each other except according to the direction X. In other words, if a part is moved according to the direction X, the other part performs the same movement.

In the present patent application, an elastic means may for example be a spring, such as a coil spring, elastic washers such as Belleville washers, an elastomer, a rubber.

In the following detailed description, use may be made of terms such as "horizontal", "vertical", "longitudinal", "transverse", "upper", "lower", "up", "down", "front", "rear", "internal", "external". These terms should be interpreted relatively with regards to the position of the entire device worn by the swimmer and in a configuration in which the swimmer stands upright on the ground or underwater.

In the context of the present invention, "completely disengaged" should be understood for two parts "A" and "B" as meaning that there is no mechanical link between the part "A" and the part "B"

For example, the "horizontal" concept could also correspond to a direction parallel to the water or ground level.

The present invention relates to an aquatic propulsion device configured to be worn by a swimmer. The use of this type of device is appropriate in particular for practicing scuba diving and prolonged swimming forces.

The present invention applies to a device comprising two independent fins, as illustrated in FIGS. 1 to 4. It also applies to a single-fin, i.e. a fin comprising a foil that is moved simultaneously by the two legs of the swimmer, as illustrated in FIG. 5. A first embodiment will now be described with reference to FIGS. 1 to 4. All of the features, technical effects and advantages mentioned for this embodiment are perfectly transposable and combinable with a single-fin type device.

As illustrated in FIG. 1 and according to one example, when the swimmer 2 is in a swimming configuration, he/she is equipped simultaneously with two propulsion devices 1 respectively attached to both of his/her legs. According to the single-fin embodiment, the swimmer 2 is equipped with one single aquatic propulsion device 1, preferably secured to the two legs 21 at the same time.

Advantageously, the device 1 is configured so as to be held in position against the leg 21 of the swimmer 2, for example at the level of the tibia, while enabling the ankle and the foot to move freely.

Thus, the device 1 is configured to be worn on the leg 21 and preferably be held in position against the tibia. Preferably, the device 1 is able to be worn by the lower part of the leg 21, namely in an area comprised between the ankle and the knee.

Figure 2:
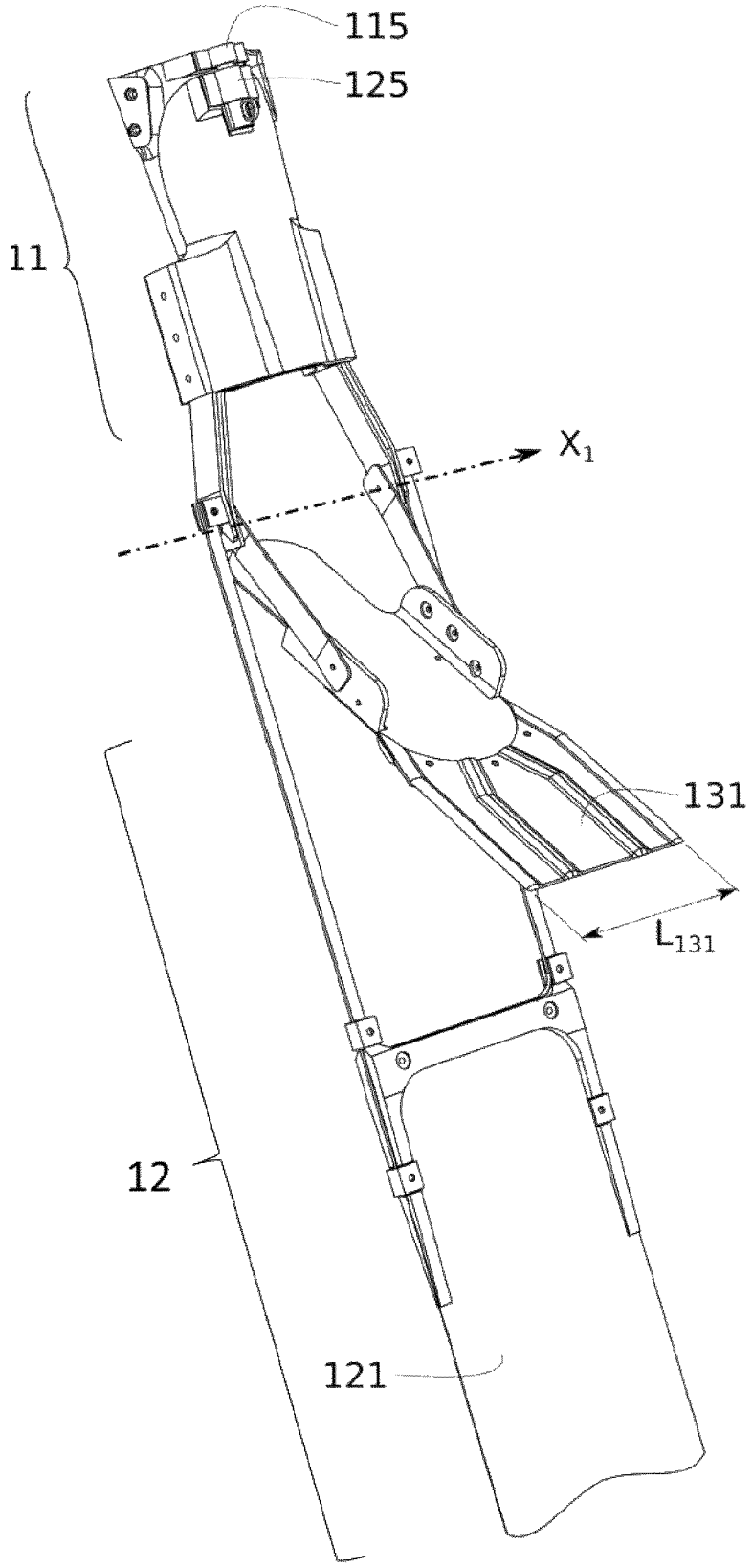
FIG. 2 shows an example of a propulsion device according to the present invention.

As illustrated in FIG. 2 and according to one example, the device 1 comprises a first portion 11 and a second portion 12. The first portion 11 being configured to enable holding of the device 1 in position on the leg 21. The second portion 12 being configured so as to be attached and/or alternatively detached with respect to the first portion 11 according to the first axis X1.

First Portion

Figure 3A:
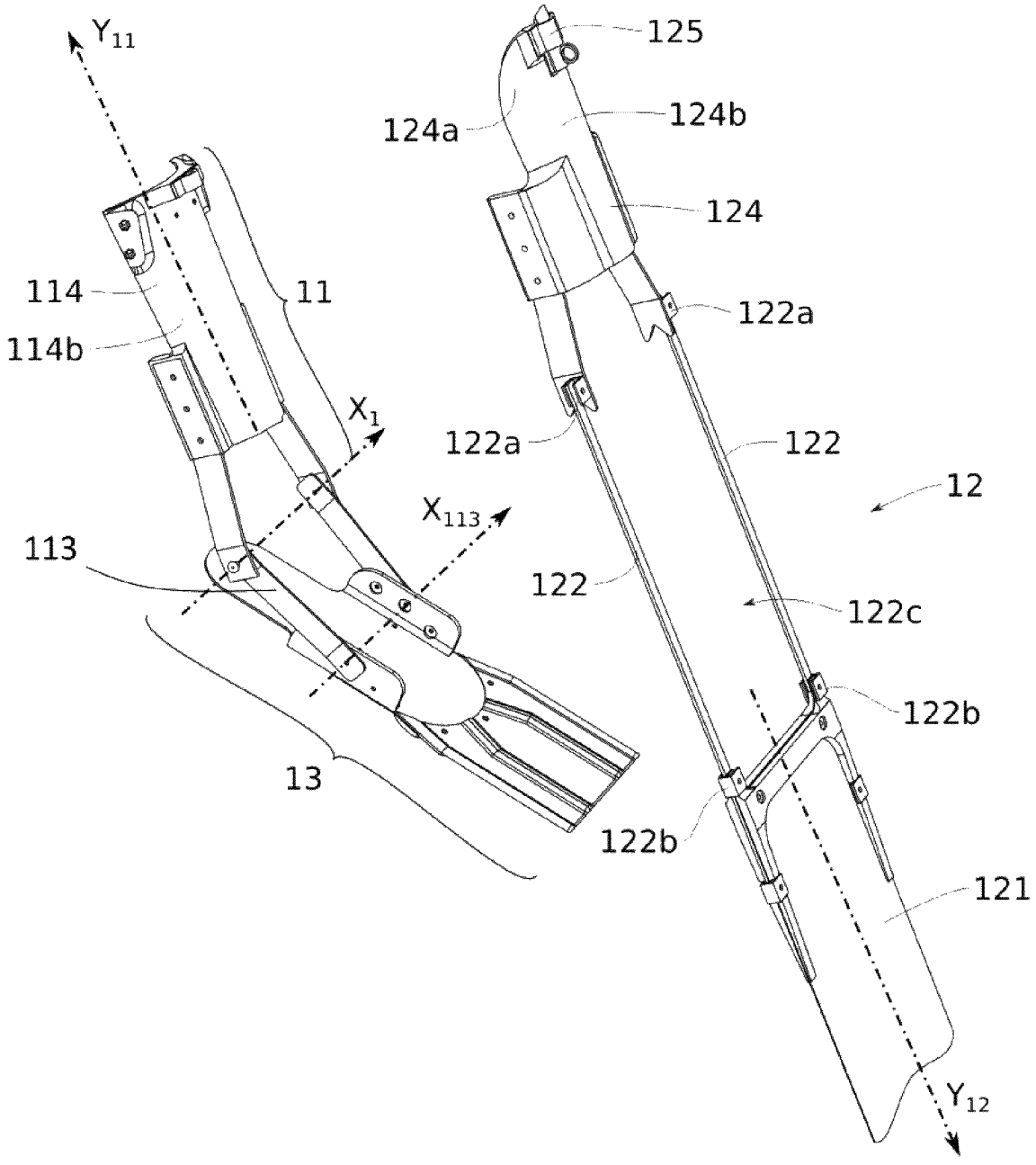
FIGS. 3A to 3D show the propulsion device illustrated in FIG. 2, comprising a first portion and a second portion, in various positions when the first and second portions cooperate together.

As illustrated in FIG. 3A and according to a particular embodiment, the first portion 11 comprises a bearing part 114. Advantageously, the bearing part 114 is carried by a rigid portion of the first portion 11. The bearing part 114 comprises a first inner face 114*a*, preferably concave, configured to wrap at least partially a portion of the leg 21 of the swimmer 2.

The first portion 11 may be a removable part, configured to be securely attached to the leg 20 of the swimmer 2 and to be detached therefrom alternately. The bearing part 114 having a first inner face 114*a* shaped so as to bear against the tibia of the swimmer 2 and a first outer face 114*b* opposite to the inner face 114*a*. The first inner face 114*a* may comprise a concave portion and/or the first outer face 114*b* may comprise a convex portion.

Second Portion

Preferably, the second portion 12 comprises a foil 121, a foil support 122, and the second bearing part 124. The foil support 122 extending between the foil 121 and the second bearing part 124 so as to mechanically transmit the forces exerted on the second bearing part 124 to the foil 21. The foil 121 being secured to the foil support 122. The second bearing part 124 being secured to the foil support 122 and being configured to enable fastening of the second portion 12 on the first portion 11 so as to enable passage of the device from a configuration detached up to an attached configuration in which the second portion extends according to the preferred direction of extension of the tibia Y21.

Preferably, when the device 1 is worn by the swimmer 2, the first axis X1 is substantially directed according to the direction defined by the malleoli of the tibia and of the fibula of said swimmer 2.

Preferably, the foil 121 is located opposite the plantar arch. The foil 121 being advantageously located in a portion of the space delimited by a plane perpendicular to the preferred direction of extension of the tibia Y21 and passing through the plantar arch.

The second bearing part 124 comprises a second inner face 124*a* opposite to a second outer face 124*b*. The second inner face 124*a* being preferably shaped so as to formally match with the first outer face 114*b*. The second inner face 124*a* may have a concave portion able to be positioned on a convex portion of the first outer face 114*b*.

Foil Support

As illustrated in FIG. 3A and according to one example, each foil support 122 has:

- a proximal end 122*a* defining with the first portion 11 an attachment interface to enable the removability of the second portion 12 with respect to the first portion 11,
- a distal end 122*b* to which the foil 121 is fastened.

According to a particular embodiment, the device is configured so that the foil 121 and the foil support 122 could be attached together and/or be detached, for example at the level of the distal end 122*b* so as to enable an optimized disassembly of the device for the bulk-related reasons.

The foil support 122 may be in the form of two profiled rods with a rectangular section.

Advantageously, the foil support(s) 122 is/are in contact with the bottom of the bearing element 114 so as to create a reaction point and thus enable the movement of the leg 21 against the bearing element 114 thereby causing an angular movement of the foil 121. Preferably, at least one foil support 122 is configured so as to ensure holding of the second portion 12 in position on the first portion 11.

Preferably, the foil support(s) 122 are parts having a plane of symmetry. Advantageously, the foil support(s) comprise (s) at least two rods, distributed in parallel around the foil 121.

Space For the Passage of the Foot

The device 1 is configured so that the foil 121 is positioned at a passage distance of at least 10 cm from the first axis X1 so as to form, in the second portion 12, a space 122*c* enabling passage of the foot of the swimmer 2 through said space 122*c* when the device 1 is in the attached configuration.

Preferably, the passage distance is at least 15 cm, preferably at least 20 cm, advantageously between 20 and 25 cm.

Said space 122*c* extends from the proximal ends 122*a* in the direction of the distal ends 122*b*. Preferably, the foil 121 is supported by a distal portion of the second portion 12, the distal portion extending from the distal ends 122*b*.

According to a particular embodiment, the foil 121 extends along the foil support 122.

Figure 4:
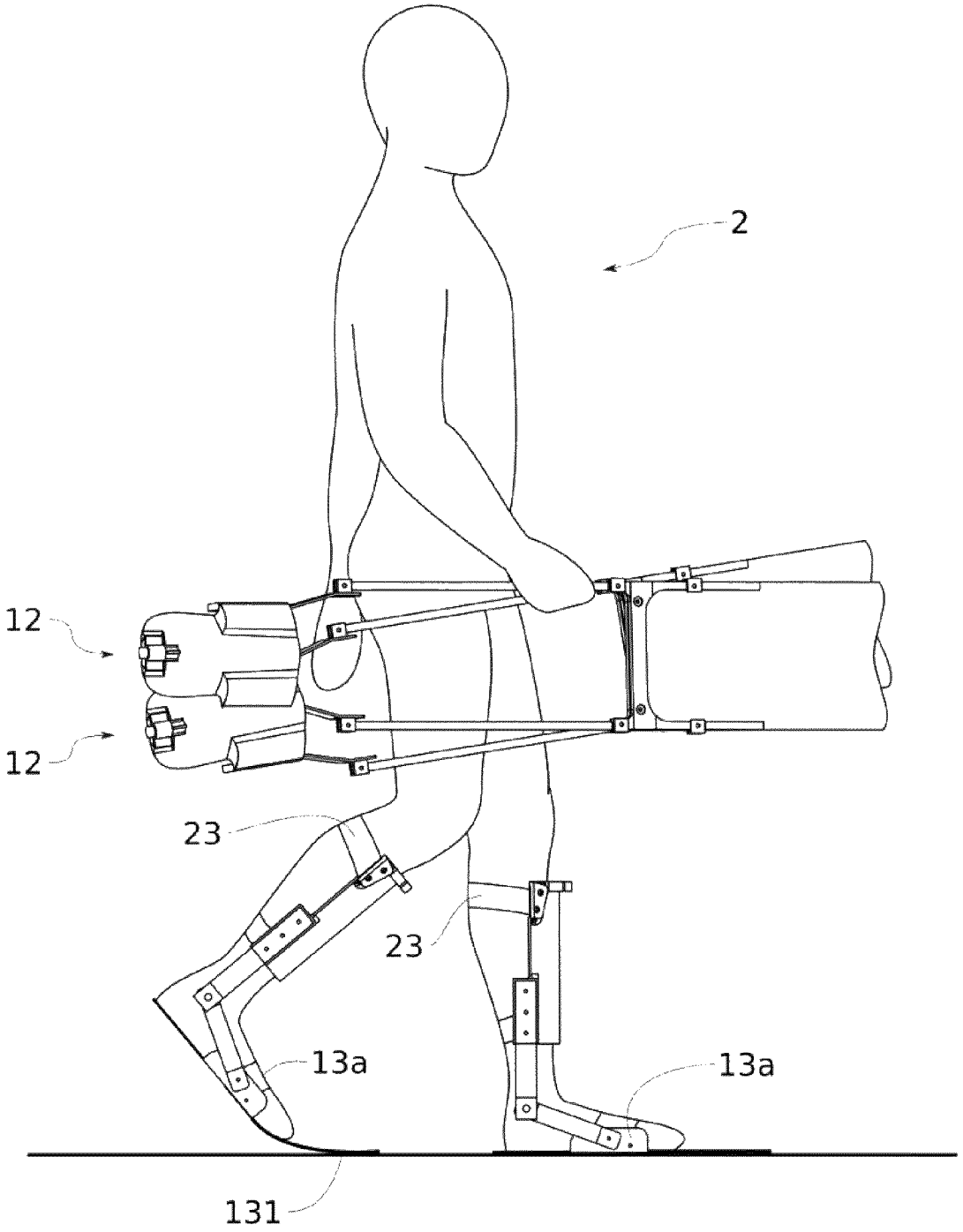
FIG. 4 shows a swimmer equipped with an example of a propulsion device according to the present invention in a walking configuration.
Figure 5:
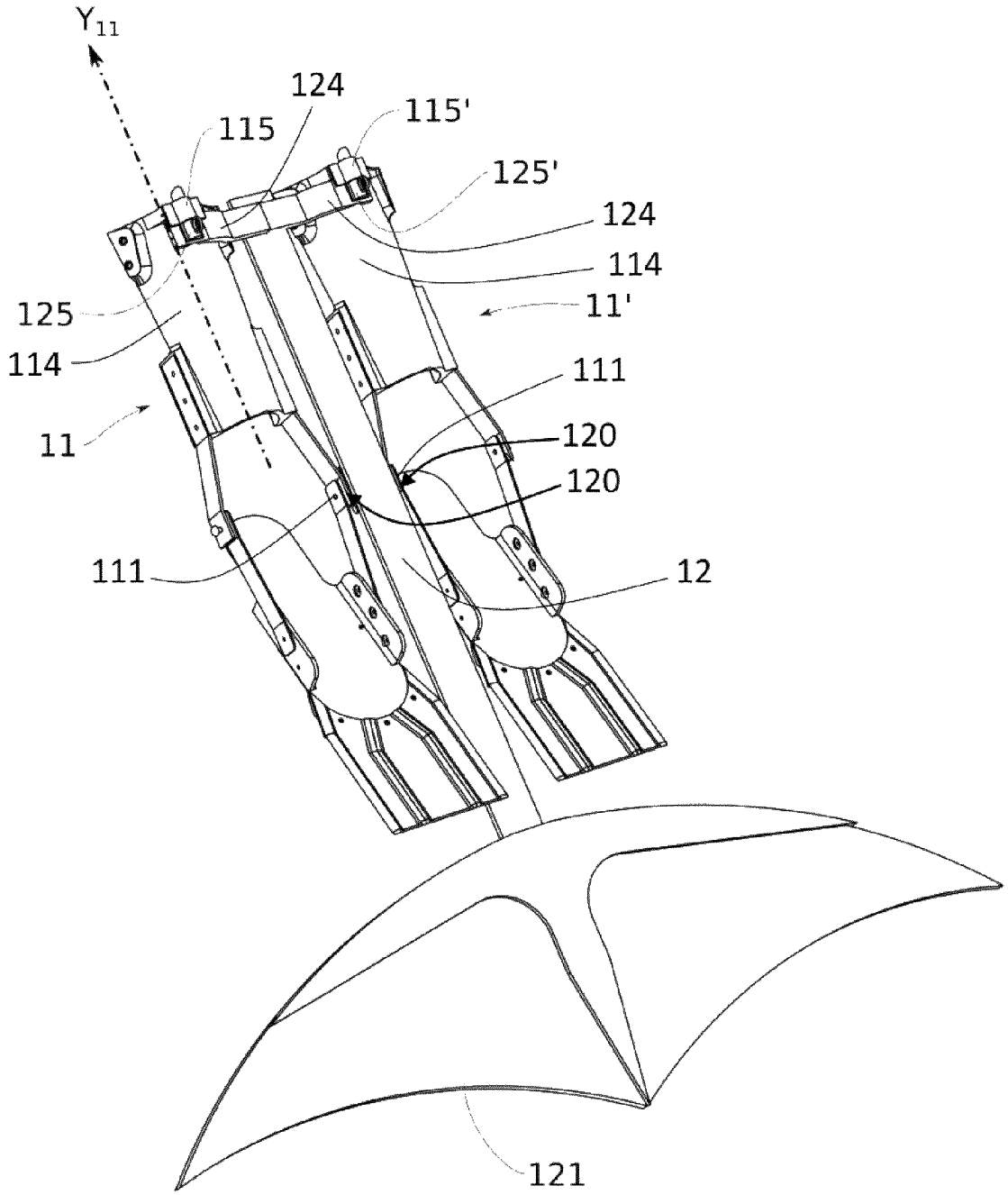
FIG. 5 shows a particular example of a single-fin device according to the invention.

The device 1 is configured so as to switch from:

- an attached configuration in which the foil 121 is configured to extend substantially, in continuation of the preferred direction of extension of the tibia Y21 of the leg 21 of the swimmer 2.
- up to a detached configuration, as illustrated in FIG. 4, in which the foil 121 is removed and can be worn easily and manually by the swimmer 2.

Switching from the detached configuration up to the attached configuration could be performed by clipping the second portion 12 with the first portion 11.

In the attached configuration, the device 1 is configured so that the foot of the swimmer 2 is located between the second bearing part 124 and the foil 121. Preferably, in the attached configuration, the main secondary direction of extension Y12 of the device 1 extends substantially in continuation of the tibia of the swimmer 2. The device 1 is in an attached configuration when the first portion 11 extends according to the main direction Y11 substantially parallel to a preferred direction Y21 of extension of the tibia and the foil 121 extends parallel to the main direction Y11.

Preferably, the device is configured so that the second portion 12 is removable with respect to the first portion 11.

Tilting

Figure 3B:
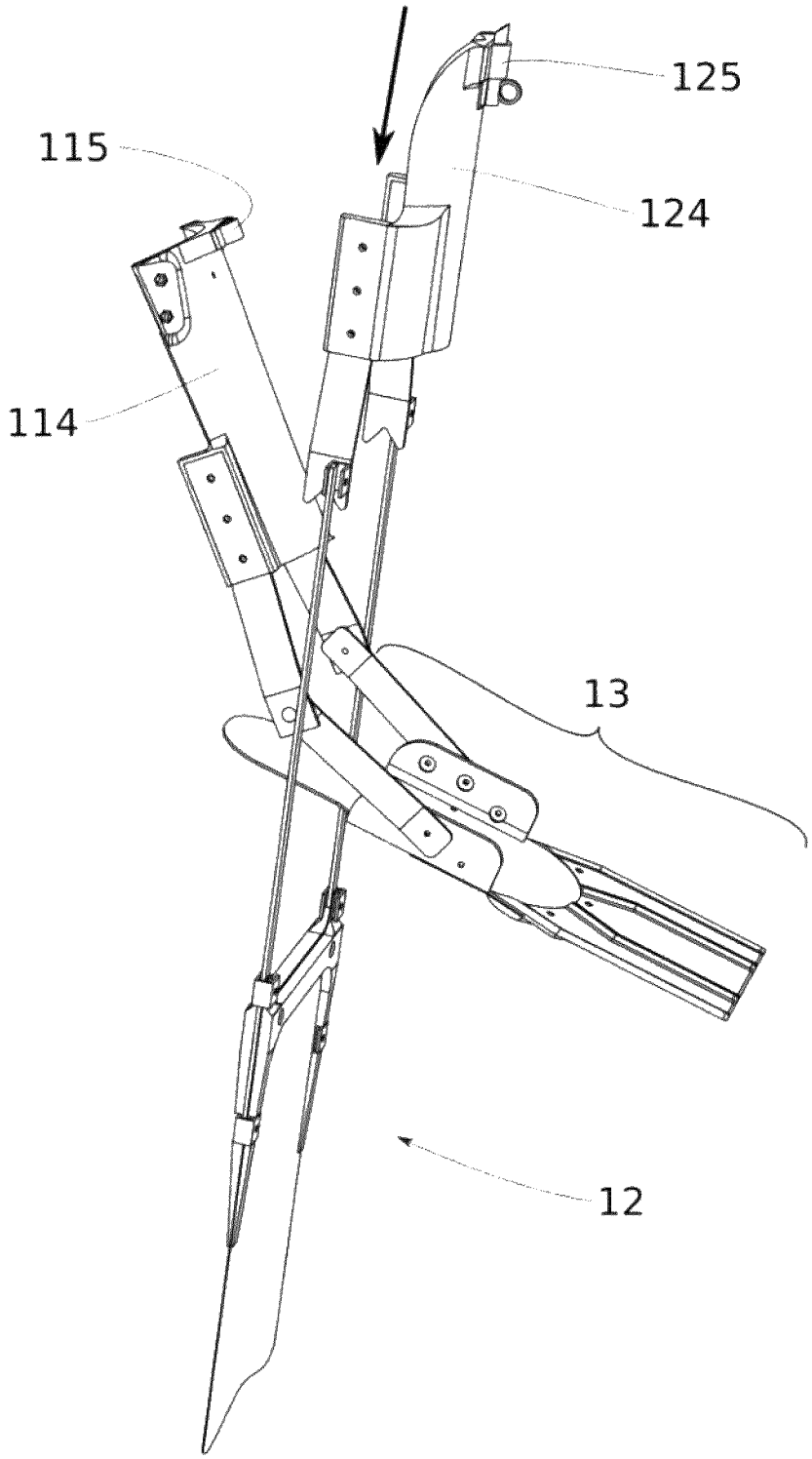
Figure 3C:
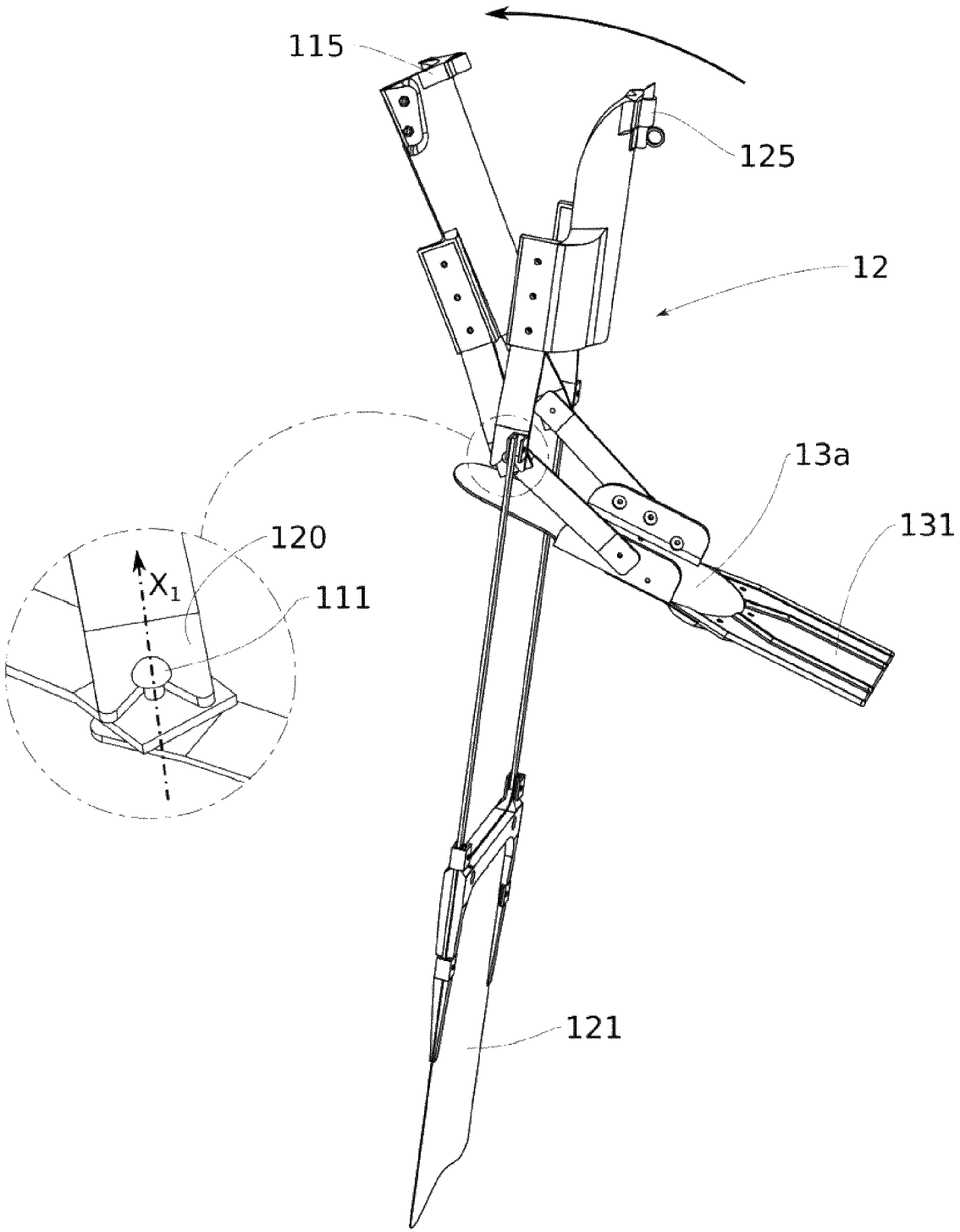
Figure 3D:
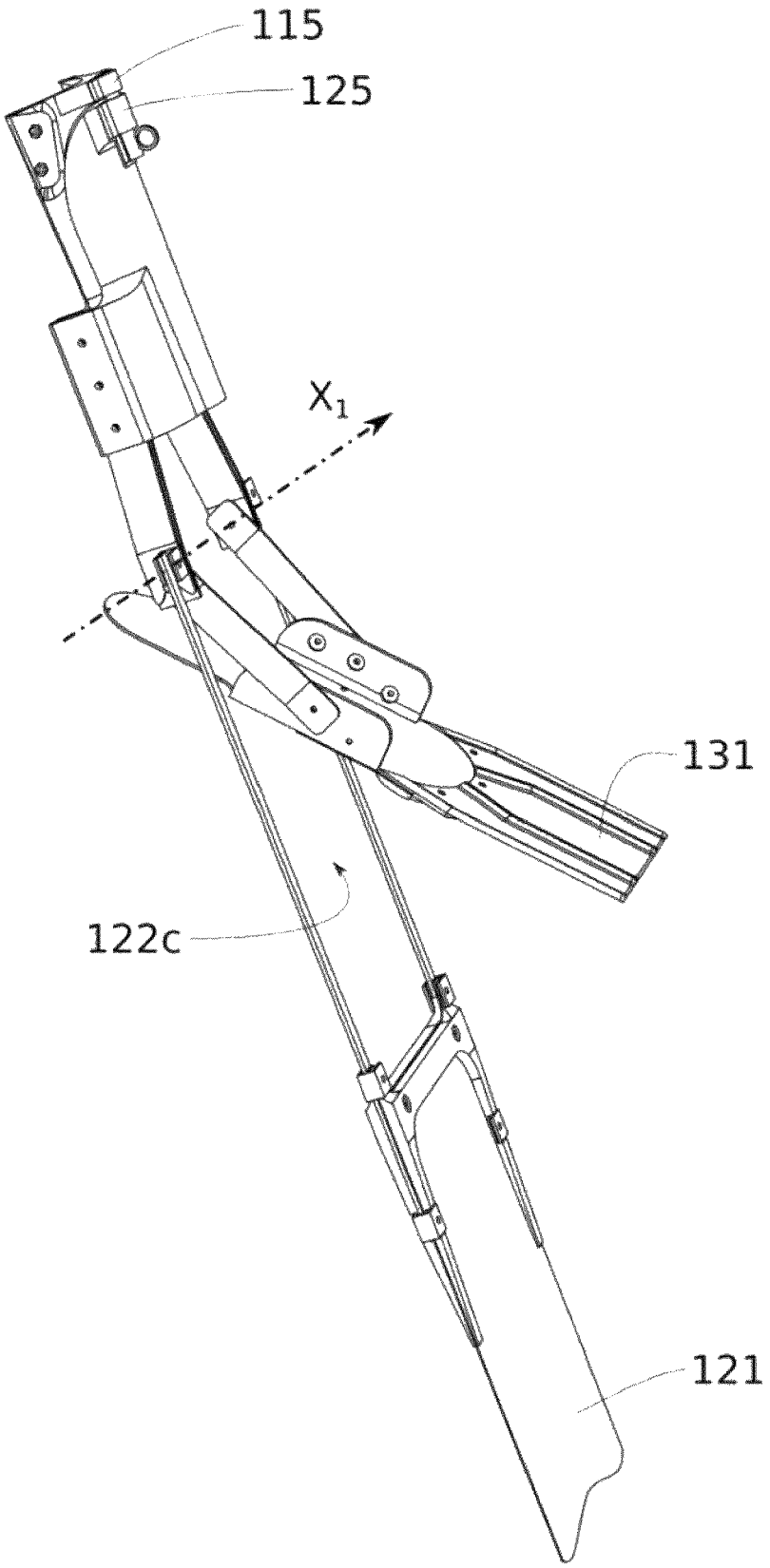

As illustrated in FIGS. 3B and 3C and according to one example, the first portion 11 and the second portion 12 are able to pivot relative to one another according to the main axis X1.

According to one example, the first portion 11 comprises a first pivot member 111 and the other one amongst the first portion 11 and the second portion 12 comprises a complementary second pivot member 120 and able to cooperate by rotation with the first pivot member 111 according to the first axis X1.

The first pivot member 111 could be a rod comprising a head and a cylindrical body. The second pivot member 120 may be a notch able to cooperate by rotation with the first pivot member 111 according to the first axis X1.

Attachment Members

According to a particular embodiment, the first portion 11 comprises a first attachment member 115 and the second portion 12 comprises a second attachment member 125. The first attachment member 115 and the second attachment member 125 being configured so as to hold the device 1 in position in the attached configuration.

According to a particular embodiment, the first attachment member 115 is located at a proximal end of the first bearing part. 114. The second attachment member 125 may be located at a proximal end of the second support part 124.

The secure cooperation between the first attachment member 115 and the second attachment member 125 being for example performed by clipping. At least one amongst the attachment members 115, 125 may comprise an elastic return element, such as a spring. It may also consist of a cooperation between a ring and a hook.

Preferably, it will consist of a clipping system wherein at least one amongst the first attachment member 115 and the second attachment member 125 comprises a female portion and the other one amongst the first attachment member 115 and the second attachment member 125 comprises a male portion configured to cooperate by fitting with the female portion.

Advantageously, the male portion is cylindrical, preferably mounted on a spring, preferably secured to the second portion 12 and/or could extend in an attached configuration according to the main direction of extension Y21. The male portion could be located on the second outer face 124*b*.

Foil With a Symmetrical Biconvex Profile

According to a particular embodiment, the foil 121 has a profile shape whose section is symmetrically biconvex. In particular, this enables the least turbulent possible swimming. The present invention combined with a foil with a symmetrically biconvex section allows recovering a powerful rotational movement about the axis of the knees of the swimmer 2 which allows developing an angular speed of the foil 121, that is much higher than with a conventional palm. Advantageously, this angular speed is accentuated and converted into a push through the use of a foil with a symmetrical biconvex profile. Preferably, a profile with symmetrical biconvex section combined with the circular movement generates a higher flow speed on the side exposed to the direction of rotation, so-called the extrados, and a lower speed on the opposite side, so-called the intrados. This flow speed shift will create lift and amplify the angular speed of the foil 121. Thus, thanks to the device of the present invention, it is possible to amplify the performance of the propulsion and swimming techniques.

Third Portion

According to a particular embodiment, the propulsion device 1 comprises a third portion 13. The third portion 13 may be rotatably articulated relative to the first portion 11 according to an articulation axis such that the first axis X1. The third portion 13 may comprise a piece of equipment 13*a* configured to accommodate the foot of the swimmer 2 at least partially.

The third portion 13 could be rotatably articulated relative to the first portion 11 according to an articulation axis different from the first axis X1, preferably extending according to a direction parallel to the first axis X1. The articulation axis could be at a distance of at least 1 cm from the first axis X1. The articulation axis could be in a worn configuration of the device according to the malleoli of the swimmer.

Advantageously, the first axis X1 extending according to the malleoli of the swimmer 2. Preferably, the additional foil 131 has a lengthwise dimension, perpendicular to the widthwise dimension, and extends under the equipment 13*a*. The reduced dimension of the additional foil 131 facilitating walking of the swimmer 2 when the second portion 12 is detached. This allows enlarging the plantar surface of the swimmer 2 and thus further increasing the propulsion force when the water is pushed back with the foot sole.

Preferably, the additional foil 131 is configured to be fastened by gluing under the equipment 13. Advantageously, the reduced dimensions of the additional foil 131 also enable the equipment 13 to pass through said space 122*c* when the device 1 is in the attached configuration.

Intermediate Member

According to one example, the third portion 13 comprises an intermediate member 113 and a piece of equipment. The equipment being configured so as to wrap the foot of the swimmer 2 at least partially and the intermediate member 113 being rotatably articulated with the first portion 11 according to an articulation axis, which could be the first axis X1, preferably the articulation axis is parallel to the first axis X1, and the equipment being rotatably articulated with the intermediate member 113 according to a second intermediate axis X113, preferably parallel to the articulation axis.

The intermediate member 113 may be in the form of a connecting rod having a rotational joint about the first axis X1 and a rotational joint about the second intermediate axis X113.

Advantageously, the equipment 13 is an accessory, such as a slipper, comprising a closed-loop profile configured to surround the foot of the swimmer 2, preferably at least at the level of the plantar arch.

The Foil Connection

According to a particular embodiment, the device comprises a removable connection mechanism between the foil 121 and the additional foil 131. Indeed, this feature allows distributing more finely the forces between the tibia 21 and the foot of the swimmer 2.

Preferably, the connection mechanism is removable. The connection mechanism may comprise a link member like a strap, a cord or an elastic. The connection could be done in a lower portion of the equipment, in particular in the portion of the equipment configured to be worn the closest to the foot of the swimmer 2. Preferably, the closest to the front of the foot of the swimmer in order to establish a connection between the foot tip of the swimmer and the foil 121. Thus, the connection mechanism enables an optimized distribution of the forces on the anterior portion of the body of the swimmer 2 as well as an adapted management of the deformation of the second foil during the rotational movements of the device 1.

According to a preferred embodiment, the device is configured so as to adapt to very different morphologies of swimmers. Proposing a distribution of the swimming forces between the foot and the lower portion of the leg. Hence, these elements characterize the invention in use thereof in the "swimming" mode, but the concept also allows innovations for use out of the water or a change of the medium.

Materials and Strength

According to one example, the foil supports 122 are shaped so as not to deform under the effect of their own weight.

According to one example, the foil supports 122 are shaped so that, when they are submerged and are deformed under the effect of a finning force applied by the swimmer 2 and then this finning force is suppressed, they could return to their rest position.

Thus, the foil supports 122 render to the device part of the force that has caused deformation thereof. This allows improving the performance of the device.

According to one example, the foil 121 is made of a first material having a Young's modulus E1 and the foil support 122 is made of a second material having a Young's modulus E2, the materials being such that E1<E2.

According to a particular embodiment, the foil 121 has a lower stiffness than the foil supports 122 so that the foil is stiffened by the foil supports 122.

Single-Fin Device

As illustrated in FIG. 5 and according to one example, the device is configured to enable fastening of one single second portion 12 simultaneously with two first portions 11 able to be worn by the swimmer 2. In other words, according to this embodiment, the device 1 comprises two distinct first portions 11, 11' respectively configured to be fastened to each of the legs of the swimmer 2.

Preferably, each of the first two portions 11, 11' comprises an attachment member 115, 115' configured to cooperate respectively with two complementary attachment members 125, 125' carried by the second portion 12, so as to alternately enable switching of the device 1 between the detached configuration and the attached configuration.

In this particular embodiment, the second bearing part 124 carrying the foil 121 may have two portions respectively complementary with the first bearing parts 114, 114 of the two first portions 11, 11' so that the device has:

an attached configuration in which the second bearing part 124 cooperates simultaneously with two first bearing parts 114 of two distinct first portions 11, 11' so as to removably secure, preferably by suppressing all degrees of freedom, the second bearing part 124 on the first outer faces 114*b* of the first bearing parts 114 in order to transmit a finning force from the first portion 11 to the unique foil 121 of the second portion 12, a detached configuration in which the cooperation of the second bearing part 124 with the first bearing parts 114 is suppressed so that the second portion is completely disengaged from the two first portions 11, 11'.

Preferably, the second portion 12 comprises at least one member among the first pivot member 111 and the second pivot member 120, preferably exactly two members among the first pivot member 111 and the second pivot member 120.

In this embodiment, the foil support 122 in the attached configuration extends between the legs of the swimmer 2, at the center of the two first portions 11, 11'. In this case, the foil support 122 could comprise one single profile.

According to one embodiment, the second portion 12 is able to cooperate by tilting simultaneously with at least two other members among the first pivot member 111 and the second pivot member 120 respectively carried by the two first portions 11, 11'. Preferably, in a worn configuration of the single-fin device, the pivot members 111, 120 are located between the legs of the swimmer 2. The second portion 12 could comprise a foil support 122 between the legs of the swimmer so that the two first portions are distributed on either side of the foil support 122.

Other Embodiments

According to a particular embodiment, the device 1 comprises sensors configured to activate triggering of an actuator in order to generate a movement of the foils 121 according to the position of the leg(s) of the swimmer 2 or according to the oscillatory movement of the swimmer 2.

Advantageously, the first portion 11 comprises an attachment system 23 allowing securing the propulsion device 1 with the leg 21 of the swimmer 2. The attachment system 23 may consist of at least one strap, preferably elastic.

The invention is not limited to the previously-described embodiments and covers all of the embodiments covered by the claims.

REFERENCES

1 aquatic propulsion device
11 first portion
111 first pivot member
114 first bearing part
114*a* first inner face
114*b* first outer face
115 first attachment member
11' first additional portion
12 second portion
12' finning support
120 second pivot member
121 foil
122 foil support
122*a* proximal end
122*b* distal end
122*c* space
124 second bearing part
124*a* second inner face
124*b* second outer face
125 second attachment member
13 third portion
13*a* equipment
2 swimmer
21 leg
22 foot
23 attachment system
Y11 main direction
Y21 preferred direction of extension of the tibia,
X1 first axis
X113 intermediate axis

The invention claimed is:

1. An aquatic propulsion device configured to be worn on at least one leg of a swimmer and comprising:

at least one first portion configured to be securely attached to the at least one leg of a user swimmer, the first portion comprising:

a first bearing part having a first inner face shaped so as to bear on a tibia of the swimmer and a first outer face opposite to the first inner face, and a second portion comprising:

a foil for propelling the swimmer, and a second bearing part carrying the foil and having a portion complementary with the first bearing part so that the aquatic propulsion device has:

an attached configuration in which the second bearing part cooperates with the first bearing part to removably secure the second bearing part on the first outer face of the first bearing part in order to transmit a finning force from the first portion to the foil of the second portion, and a detached configuration in which the cooperation of the second bearing part with the first bearing part is suppressed so that the second portion is completely disengaged from the first portion.

2. The aquatic propulsion device according to the claim 1, configured so that, in the attached configuration, the second portion is secured to the first portion only by said cooperation between the second bearing part and the first bearing part.

3. The aquatic propulsion device according to claim 1, wherein the first portion comprises a first attachment member and the second portion comprises a second attachment member complementary with the first attachment member, an actuation of one amongst the first and second attachment members allows alternately switching between:

a locked configuration in which the first and second attachment members cooperate to lock the aquatic propulsion device in the attached configuration, and an unlocked configuration in which the first and second attachment members enable switching of the aquatic propulsion device from the attached configuration into the detached configuration.

4. The aquatic propulsion device according to the claim 3, wherein the first and second attachment members cooperate by clipping or via a latch mechanism.

5. The aquatic propulsion device according to claim 3, configured so that actuation of one amongst the first and second attachment members is performed by handling the one amongst the first and second attachment members by the swimmer so as to switch from the attached configuration into the detached configuration.

6. The aquatic propulsion device according to claim 3, wherein the actuation of one amongst the first and the second attachment members is caused by cooperation of the second portion on the first portion to switch from the detached configuration into the attached configuration.

7. The aquatic propulsion device according to claim 1, wherein the first portion comprises a first pivot member, secured to the first bearing part and the second portion comprises a second pivot member, the first and second pivot members being configured to cooperate so as to switch from the detached configuration into the attached configuration by tilting of the second bearing part relative to the first bearing part.

8. The aquatic propulsion device according to claim 7, wherein the first pivot member and the second pivot member are configured so as to guide a relative movement of the second bearing part relative to the first bearing part when alternately switching from the detached configuration into the attached con-figuration, according to a rotation about a first axis substantially perpendicular to a main direction of extension of the tibia.

9. The aquatic propulsion device according to claim 7, configured so that an amplitude of a rotation by tilting of the second portion relative to the first portion is limited by contact between a second inner face and the first outer face.

10. The aquatic propulsion device according to claim 7, wherein the first and second pivot members are configured so as to cooperate at an end of a tilting movement, responsive to contact between a second inner face of the second portion with the first outer face of the first portion.

11. The aquatic propulsion device according to claim 1, wherein the first portion comprises a first attachment member and the second portion comprises a second attachment member complementary with the first attachment member, an actuation of one amongst the first and second attachment members allows alternately switching between:

a locked configuration in which the first and second attachment members cooperate to lock the aquatic propulsion device in the attached configuration, and an unlocked configuration in which the first and second attachment members enable switching of the aquatic propulsion device from the attached configuration into the detached configuration, wherein actuation of one amongst the first and the second attachment members is performed manually without any tool.

12. The aquatic propulsion device according to claim 1, configured so that, in the attached configuration, the second portion is secured to the first portion only by said cooperation between the second bearing part and the first bearing part, and wherein, in the attached configuration, the foil is positioned at a distance of at least 10 cm from the first bearing part so as to form in the second portion an opening enabling passage of a foot of the user through said opening.

13. The aquatic propulsion device according to claim 1, wherein, in the attached configuration, the foil extends substantially, in continuation of a direction of the tibia of the swimmer.

14. The aquatic propulsion device according to claim 1, wherein the second portion comprises at least one foil support connecting the second bearing part to the foil, the foil support being able to elastically deform during use, under an effect of a finning force applied by the swimmer.

15. The aquatic propulsion device according to claim 1, comprising a third portion comprising an intermediate member and a piece of equipment configured so as to accommodate at least partially a foot of the swimmer, the intermediate member being rotatably articulated with the first portion according to a first axis, and the piece of equipment being rotatably articulated with the intermediate member according to an intermediate axis parallel to and not coincident with the first axis.

16. The aquatic propulsion device according to claim 15, wherein the second portion is configured to form between a second bearing surface and the foil a space enabling, in the attached configuration, free movement of the third portion throughout said space and relative to the second portion.

17. The aquatic propulsion device according to claim 15, comprising an additional foil secured to the piece of equipment and configured to be positioned under the foot of the swimmer, the additional foil having a widthwise dimension, according to the first axis, substantially with a same size as a width of the piece of equipment.

18. The aquatic propulsion device according to claim 1, wherein the second bearing part has a curved surface to interlock with the first bearing part.

19. The aquatic propulsion device according to claim 1, comprising:

two distinct first portions respectively configured to be fastened to each of the at least one leg of the swimmer.

20. The aquatic propulsion device according to claim 19, wherein the two first portions respectively comprise an attachment member configured to cooperate each with a complementary attachment member carried by a unique second portion configured to cooperate simultaneously with the two first portions, the second portion thereby allowing securing the two first portions in the attached configuration.

* * * * *